United States Patent [19]

Betzler

[11] 4,026,463

[45] May 31, 1977

[54] CIRCULAR SLIDE RULE SUITABLE FOR USE IN DETERMINING THE ELECTROLYTE DEFICIENCY IN INFUSION THERAPY

[75] Inventor: Hermann Betzler, Homburg, Saar, Germany

[73] Assignee: Salvia-Werk Gesellschaft m.b.H., Homburg, Saar, Germany

[22] Filed: Oct. 2, 1975

[21] Appl. No.: 618,806

[52] U.S. Cl. ..... 235/88 R; 235/78 R

[51] Int. Cl.[2] ..... G06C 3/00

[58] Field of Search ..... 235/83, 84, 77, 78 R, 235/78 M, 88 R, 88 M

[56] References Cited

UNITED STATES PATENTS

| | | | |
|---|---|---|---|
| 1,207,439 | 12/1916 | Picolet | 235/84 |
| 1,338,588 | 4/1920 | Prescott | 235/84 |
| 1,849,058 | 3/1932 | Dempster | 235/84 |

FOREIGN PATENTS OR APPLICATIONS

| | | | |
|---|---|---|---|
| 586,215 | 3/1947 | United Kingdom | 235/84 |

*Primary Examiner*—Ulysses Weldon

*Attorney, Agent, or Firm*—Richard A. Speer

[57] ABSTRACT

A circular slide rule is provided suitable for use in a method determining the electrolyte deficiency in the extra-cellular space from the measured electrolyte deficiency per volume of serum, body weight and body height, and is a method of determining electrolyte deficiency therewith. The circular slide rule comprises a basic disc, a centrally rotatable first rotary disc supported on one side of the basic disc but having a smaller diameter than the basic disc and a centrally rotatable second rotary disc supported on the side of the basic disc opposite to that of the first rotary disc but having a diameter smaller than that of the basic disc. Substantially straight cursors are also provided, each being rotatably supported on one of the rotary discs relative to the appropriate rotary disc and with respect to the basic disc, each said cursor extending at least to the circumference of the basic disc.

6 Claims, 3 Drawing Figures

Figure 2:
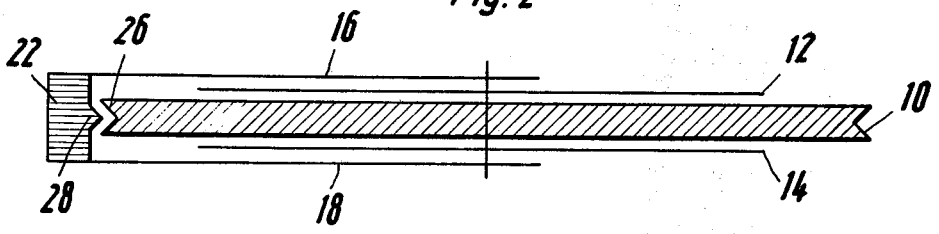

CIRCULAR SLIDE RULE SUITABLE FOR USE IN DETERMINING THE ELECTROLYTE DEFICIENCY IN INFUSION THERAPY

BACKGROUND OF THE INVENTION

This invention relates to a circular slide rule suitable for use in determining the electrolyte deficiency in the extracellular space from the measured electrolyte deficiency per liter serum, from the body weight and the body size.

It is known that the electrolyte deficiency in the extracellular space (hereinafter generally referred to as "*ECR*") of infants, children and adults can be determined from three known values, namely the change of electrolyte concentration in the serum in mVal/liter, the body weight in kg and body height in cm. The theorectical basis for this determination is found in the linear dependence of *ECR* on the body surface area (hereinafter generally referred to as "*KO*") which is independent of age, sex and constitution and is expressed by the formula:

$$ECR_{(kg)} = 6.04 \times KO_{(m^2)}$$

and by the functional dependence of the body surface area ($m^2$) on the body weight (kg) and the body height (cm) in accordance with the formula:

$$KO_{(cm^2)} = kg^{0.425} \times cm^{0.725} \times 71.84$$

Clinical balancing in specific electrolyte therapy is usually performed by calculating the required amount of electrolyte to be supplied from the product:

change of serum concentration in mVal/liter × KG(kg)/5The quotient KG (kg)/5 in this case is characterized as the magnitude of ECR (kg). However, even in adults, this formula will provide only a very rough approximation to the actual value of ECR. Errors of up to 100% are likely in children and even more in the case of infants.

Measurements have shown that the ECR value is approximately 39% by weight at birth and approximately 27% by weight for a body weight of 10 kg. In adults, the ECR value is reduced to approximately 15% by weight for a body weight of 100 kg. The wrong treatment will be frequently applied when taking into account the usual "mean value" of 20% by weight of ECR proportion of the body weight. To this extent, various tables and mechanical calculating aids based on the above-stated theoretical basis and in use in various embodiments are not suitable for providing satisfactory therapeutic results.

It is known that there is a linear relationship between the surface area of the body and the magnitude of the ECR value. The amounts of water and electrolyte required to be supplied for daily use are, therefore, usually stated in relation to the body surface area by specialists for electrolyte therapy. New investigations in recent years have shown that, by contrast to the intracellular space, the linear function of the ECR to the body surface area remains constant not only at different ages but also with different sexes and a different body constitution. It is, therefore, sensible to relate the calculation of the electrolyte efficiency in the ECR to the body surface area and not to the body weight.

Special nomograms for children and adults were developed some considerable time ago, from which nomograms the body surface area can be obtained in dependence on the body weight and the body height. For accurate electrolyte therapy, it is necessary to multiply these values of body surface area obtained from two different nomograms with the values of electrolyte deficiency per liter of serum as defined in the laboratory and with the conversion factor of the body surface area/ECR relationship either by means of an additionally required conventional slide rule or by a written calculation.

The entire operation of reading the nomograms followed by further conversion and multiplication of the values obtained with due reference to the measured values is very time-consuming and above all very awkward.

It is an object of the present invention to provide a circular slide rule for use in infusion therapy, which circular slide rule can be easily handled and used to rapidly supply precise values of electrolyte deficiency for infusion therapy. The circular slide rule is to be of simple and handy construction and its circumference should be sufficiently small to enable the physician to carry the same readily in a smock pocket or the like.

According to the first aspect of the present invention there is provided a circular slide rule suitable for use in determining the electrolyte deficiency in the extracellular space from the measured electrolyte deficiency per volume of serum, body weight and body height, which circular slide rule comprises a basic disc, a centrally rotatable first rotary disc supported on one side of the basic disc but having a smaller diameter than the basic disc, a centrally rotatable second rotary disc supported on the side of the basic disc opposite to that of the first rotary disc but having a diameter smaller than that of the basic disc, and substantially straight cursors, each being rotatably supported on one of the rotary discs relative to the appropriate rotary disc and with respect to the basic disc, each said cursor extending at least to the circumference of the basic disc.

According to the second aspect of the present invention there is provided a method of determining the electrolyte deficiency in the extracellular space, which method comprises determining the electrolyte from the measured electrolyte deficiency per volume of serum, body weight and body height, utilizing a circular slide rule which comprises a basic disc, a centrally rotatable first rotary disc supported on one side of the basic disc but having a smaller diameter than the basic disc, a centrally rotatable second rotary disc supported on the side of the basic disc opposite to that of the first rotary disc but having a diameter smaller than that of the basic disc, and substantially straight cursors, each being rotatably supported on one of the rotary discs relative to the appropriate rotary disc and with respect to the basic disc, each said cursor extending at least to the circumference of the basic disc.

In a preferred embodiment of the invention, the cursors are provided with an optical radial scale marking.

Further features which are preferred in the present invention are disclosed hereinafter. It has been found particularly advantageous that each of the rotating discs is provided with a body weight and body height scale and an associated scale of change of electrolyte concentration and the basic disc is provided on both sides with a scale indicating the magnitude of the extracellular space (ECR) and a scale indicating the required infusion thereapeutic electrolyte deficiency.

To this end, one of the rotary discs can for example cover a body weight range of from 2.5 to 25 kg, a body height range of from 45 to 125 cm and a ΔmVal range of from 1 to 10 mVal and the other rotary disc can for example cover a body weight range of from 25 to 100 kg, a body height range of from 125 to 200 cm and a ΔmVal range of from 1 to 10 mVal, and it is also proposed that the scales disposed on one of the rotary discs can have different lengths for identical radii and complement each other to form a total scale of 360°.

Another embodiment of the invention is provided with scale lengths of the body weight (kg) and of the body height (cm) on each rotary disc which are related to each other as the differences between the logarithms of the appropriate scale starting values and scale end values of the body weight scales (kg) on the one hand and of the body height scales on the other hand on the circular scale. It can also be provided that the circumferential edge of the basic disc is provided with the scale indicating the required infusion-therapeutic electrolyte deficiency and, within the scale but on a smaller radius, the ECR scale. To this end, it is advantageous if the scale length of the ECR scale is proportional to the sum of the scale lengths for body weight and body height with due reference to the radius which is enlarged relative to the total scales of the rotary disc, and it can be provided more particularly that the scale divisions of the ECR scale are selected so that the sum of distances on the kg (body weight) scale and the cm (body height) scales provides the associated value on the ECR scale when based on the formula:

$$\log ECR_{(kg)} = \log 0.1009888 + 0.5 \times \log \text{"kg"} + 0.5 \times \log \text{"cm."}$$

In the preferred embodiment of the present invention, the ΔmVal scales of the rotary discs have a length which is such that their linear addition to the length of the ECR scale of the basic disc results in a full circle circumference, correspond to the mVal scale of the required infusion-therapeutic electrolyte deficiency and the scale lengths of the ΔmVal scales and of the ECR scales are related to each other as the differences of the logarithms of the appropriate scale beginning values and scale end values on the ΔmVal scales on the one hand, and on the ECR scales on the other hand when referred to a radius of identical size.

Figure 3:
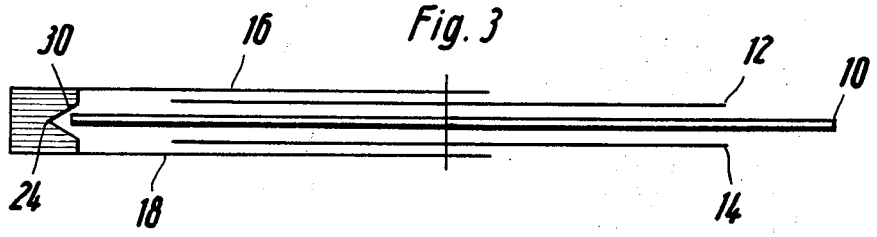
Figure 1:
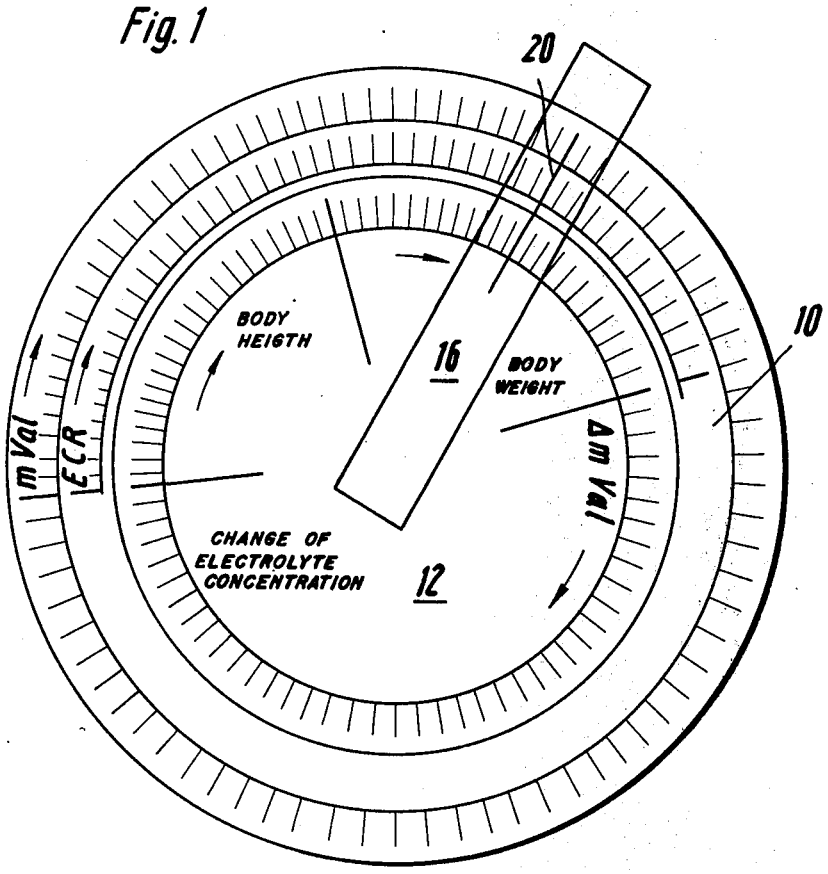

For a better understanding of the present invention and to show how the same may be carried into effect, reference will now be made, by way of example, to the accompanying drawing, in which:

FIG. 1 shows a plan view of an embodiment of the circular slide rule in accordance with the present invention, FIG. 2 shows a diagrammatic radial section through the embodiment of FIG. 1, and FIG. 3 shows a diagrammatic radial section of a modified embodiment.

Referring now to the drawing, a circular slide rule consisting of four parts in accordance with the invention comprises a basic disc 10 on which two rotary discs 12 and 14 as well as two cursors 16 and 18 are centrally and rotatably supported. The diameter of the disc 10 in the illustrated embodiment is 13 cm so that the entire circular slide rule can be carried in the pocket of a physician's smock. The rotary discs 12 and 14 on the other hand have a diameter of 9.3 cm. The cursors 16 and 18 are transparent and are constructed, for example, of transparent plastics material and have a radius so that they project beyond the circumferential edge of the basic disc 10. A straight line marking 20 on the cursors 16 and 18 facilitates reading of the values indicated on the discs. The line marking 20 is sufficiently long in the radial direction so as to extend over the range of all scales of the basic discs and rotary discs which have a different radius (described hereinafter).

The ends of the two rotatable cursors 16 and 18 are also joined to each other outside the circumferential edge of the basic disc 10 so as to produce a stress which is centripetally oriented towards the edge of the basic disc 10. The stress must be sufficiently large to ensure that rotation of the cursors 16 and 18 with respect to the basic disc 10 results in rotary friction which is such that the cursors 16 and 18, rigidly joined to each other by means of the cursor connection 22 and 24, can still be relatively readily rotated but the position of the cursor system is not altered when the discs 16 and 18 are rotated. This can be achieved, in the manner shown in FIG. 2, by providing the outer circumferential edge of the basic disc 10 with an annular groove 26 into which a projection 28 of the cursor connection 22 engages or, in the manner shown in FIG. 3, by the outer circumferential edge of the basic disc 10, which is thinner in the illustrated embodiment, being smooth and being adapted to engage into a recess 30 of the cursor connection 24.

It is also possible to arrange for the necessary stress and friction of the cursor system 16 and 18 on the edge of the basic disc 10 to be ensured by the incorporation of a corresponding spring device into the cursor connection 22 and 24.

The basic disc and the two rotary discs are divided by means of corresponding scales in the following manner:

The numerals required for the independent variables, namely body weight (kg), body height (cm) and change of electrolyte concentration (ΔmVal) are situated on a common circular scale on the rotary discs. The rotary disc 12, intended for pediatric use, has a body weight range of 2.5 to 25 kg, a body height range of 45 to 125 cm and a ΔmVal range of 1 to 10 mVal. The disc 14 which is intended for adult therapy covers a body weight range of from 25 to 100 kg, a body height range of from 125 to 200 cm and a ΔmVal range of from 1 to 10 mVal. The scales of the ECR magnitude and of the required infusion-therapeutic electrolyte deficiency (mVal) are calculated differently on both sides of the basic disc 10 in accordance with the scales on the rotary discs 12 and 14.

The ratio of the scale lengths of the two independent variables of body weight (kg) and body height (cm) is as the ratio of the differences between the logarythms of the appropriate scale beginning values and scale end values of the body weight scales on the one hand and of the body height scales on the other hand, the sum of the two scale lengths and the length of the ΔmVal scale corresponding to the circular circumference of the total scale which has a cross-section of 7.8 cm.

The ECR scale has a diameter of 9.8 cm on the basic disc 10. The scale length is proportional to the sum of the scale lengths of body weight and body height with due allowance for the increase of radius with respect to that of the previously mentioned three independent variables. The scale calibration of the ECR scale is calculated so that when based on the formulae:

$$ECR_{(kg)} = 6.04 \times KO \ (\text{m}^2)$$

and $$KO(cm^2) = kg^{0.425} \times cm^{0.725} \times 71.84$$

or if derived therefrom:

$$\log ECR_{(kg)} = \log 0.1009888 + 0.5 \times \log \text{"kg"} + 0.5 \times \log \text{"cm"}$$

the sum of the distances on the kg scale and on the cm scale provides and indicates the required value on the ECR scale, namely proportionally taking into account the increased radius of the ECR scale. In the above-mentioned formulae KO refers to the body surface area in $M^2$ or in the above-mentioned second formula in $cm^2$, kg refers to the body weight in kg and cm refers to the body height in cm.

The length of the ΔmVal scales on the rotary discs is calculated with respect to the above so that its linear addition to the length of the ECR scale results in a full circle circumference on the basis disc 10 corresponding to the scale for the required infusion-therapeutic electrolyte deficiency (mVal) with a cross-section of 11.4 cm. The system is also calculated so that the ratio between scale lengths of the ΔmVal scales and of the ECR scales, referred to a radius of identical size, varies as the differences between the logarithms of the appropriate scale beginning values and scale end values on the ΔmVal scales on the one hand and on the ECR scales on the other hand.

This ensures that the desired multiplication of the previously calculated ECR value with the mVal value is obtained by simple addition of a distance on the ECR scale to the preset distance on the ΔmVal scale. The required end value can then by obtained from the outer scale of the basic disc, namely the mVal scale, if the mVal values of this scale are calculated and logged by analogy with the kg values of the ECR scale, taking into account the different radii. The kg numerals on the ECR scale are evaluated at identical height in volumetric units such as liters. Owing to the very low specific gravity of the extracellular fluid, the inherent error resulting from this procedure can be neglected.

The entire system can be calculated so that, for the purpose of obtaining optimum reading accuracy, the end value scale (mVal) just occupies a complete circle circumference on the basic disc. The lengths of all other scales are shortened to a greater or lesser extent because of their different functional dependencies and relationships.

To increase the accuracy of indication, the ΔmVal scale is limited to values between 1 and 10 mVal, the end values being divided by or multiplied by 10 for ΔmVal values of less than 1 mVal or above 10 mVal.

Operation of the circular slide rule according to the invention is as follows:

The scale beginning of the kg scale on the rotary disc 12, 14 in use is set radially to the beginning of the ECR scale and to the beginning of the mVal scale of the basic disc 10, a check being provided by the line marking 20 of the appropriate cursor 16 and 18. The known body weight in kg is then found on the scale and set by means of the straight line marking of the rotary cursor. The scale beginning of the cm scale is then set to the line marking 20 of the cursor, the value of body height is then found on the scale and again set by means of the line marking 20. The sum of the two distances is then defined on the ECR scale by means of the rotary cursor. The required ECR value can thus be directly obtained but this is not necessary.

The beginning of the ΔmVal scale is then set to the line marking, the desired ΔmVal value is found and marked by means of the cursor. The straight line marking of the cursor will then provide the required end value of infusion-therapeutic electrolyte deficiency on the outer scale, namely the mVal scale. It should be noted that the first two steps, namely joining the scale distances of kg and cm can of course be interchanged.

To those skilled in the art to which this invention relates, many changes in construction and widely differing embodiments and applications of the invention will suggest themselves without departing from the spirit and scope of the invention. The disclosures and description herein are purely illustrative and are not intended to be in any sense limiting.

What I claim as new and desire to secure by Letters Patent of the United States is:

1. A calculating disc for determining the electrolyte deficiency (mVAL) in the extracellular space (ECR) from the measured electrolyte deficiency per liter of serum (ΔmVAL), body weight (kg) and body size (cm) comprising a base disc, a first dial mounted in central and rotary manner on one side of the base disc and having a smaller diameter than said base disc, a second dial mounted centrally and in rotary manner on the side of the base disc opposite to the first dial and having a smaller diameter than said base disc, a first and second substantially straight pointers made from transparent material and having radial stroke markings and extending over the peripheral edge of the base disc, mounted respectively in rotary manner on said first and second dials the ends of the two pointers projecting over the periphery of the base disc being interconnected, first, second and third scales on said first and the said second dials having in each case a different scale length with the same radii and when engaged with another forming a complete scale of 360° , the scale lengths of the first and second scales on each dial relative to one another behaving in the same way as the difference values of the logarithms of the particular minimum and maximum scale readings of the first scales on the one hand and the second scales on the other, and a fourth scale (mVAL) on the peripheral edge of base disc (10) and concentrically within the fourth scale a fifth scale (ECR), whose scale length is proportional to the sum of the scale lengths of the first and second scales.

2. A calculating disc according to claim 1, characterized in that the graduation of the fifth scale (ECR) is selected in such a way that, based on the formula $\log ECT_{(kg)} = \log 0.1009888 + 0.5 \times \log \text{"kg"} + 0.5 \times \log \text{"cm"}$, the sum of the lines on the first scale (kg) and the second scale (cm) gives the appropriate value on the fifth scale.

3. A calculating disc according to claim 2, characterized by such a length of the third scale (ΔmVal) of the first and second dials that their linear addition to the length of the fifth scale (ECR) of the base disc gives a full periphery, corresponding to the fourth scale (mVal), and that the scale length of the third and fifth scales, relative to an equally large radius, behave relative to one another in the same way as the difference values of the logarithm of the particular minimum and maximum scale readings on the third scales on the one hand and the fifth scales on the other.

4. A calculating disc according to claim 1, wherein said base disc (10) includes a V-shaped guide slot (26) and the connected ends of said pointers have a projection (28) to cooperate with said guide slot.

5. A calculating disc according to claim 1, wherein the pointers connection (24) engages over the peripheral edge of the base disc (10) with a recess (30), which is V-shaped.

6. A calculating disc according to claim 1, wherein a spring device is provided in the pointers connection (22, 24) for maintaining a centripetal tension of clearly defined size between the pointers connection and the edge of the base disc (10).

* * * * *